United States Patent [19]

Yamamoto et al.

[11] 4,382,375

[45] May 10, 1983

[54] METHOD OF ROLLING METAL STRIP

[75] Inventors: Hiroyasu Yamamoto, Kitakyushu; Koe Nakajima, Nakama; Minoru Kawaharada; Yuji Uehori, both of Kitakyushu, all of Japan

[73] Assignee: Nippon Steel Corporation, Tokyo, Japan

[21] Appl. No.: 270,123

[22] Filed: Jun. 3, 1981

[30] Foreign Application Priority Data

Jan. 14, 1980 [JP] Japan ..... 55/2094

[51] Int. Cl.[3] ..... B21B 39/08

[52] U.S. Cl. ..... 72/205; 72/232; 72/366

[58] Field of Search ..... 72/199, 205, 232, 366

[56] References Cited

U.S. PATENT DOCUMENTS 3,709,017 1/1973 Vydrin et al. ..... 72/366

3,911,713 10/1975 Vydrin et al. ..... 72/366

FOREIGN PATENT DOCUMENTS 54-84850 7/1979 Japan .

*Primary Examiner*—Francis S. Husar

*Assistant Examiner*—Jonathan L. Scherer

*Attorney, Agent, or Firm*—Wenderoth, Lind & Ponack

[57] ABSTRACT

Three or more work rolls are arranged substantially in line with each other so that the adjoining work rolls each form a roll pass between them. The work rolls are driven in such a way that the rolls closer to the exit end of the rolling mill stand rotate with increasingly greater peripheral speeds. Metal strip is continuously passed through each roll pass and is wound around part of the periphery of the work rolls disposed between the work rolls at both ends of the stand. Thus, the strip is rolled between each pair of the adjoining work rolls. The work rolls are also driven in such a way that at least in one of the pairs of the work rolls, the peripheral speed of the higher-speed work roll is greater than the speed with which the strip leaves the roll pass formed by the pair of work rolls.

5 Claims, 12 Drawing Figures

METHOD OF ROLLING METAL STRIP

BACKGROUND OF THE INVENTION

This invention relates to a method of rolling metal strip. More particularly, it relates to a method of rolling metal strip in which the workpiece is continuously passed through a plurality of pairs of work rolls in a single stand so as to run around part of the periphery of one work roll after another, whereby the thickness of the workpiece is reduced by the pairs of work rolls.

Similar metal strip rolling methods are disclosed in, for example, U.S. Pat. Nos. 3,709,017 and 3,823,593.

This type of metal strip rolling method (hereinafter called single-stand multi-pass rolling) has the advantage, at least theoretically, that a large reduction in thickness can be achieved by an application of a relatively light load while at the same time using a compact rolling mill.

However, studies performed by the inventors have shown that in a conventional single-stand multi-pass rolling method, the tension acting on the strip on the exit side of the work rolls becomes higher as the draft, or amount of reduction, increases. When the total draft achieved in the roll stand becomes as high as, for example, 70 percent, the tension on the strip on the exit side of the stand can exceed the tensile strength of the strip. Accordingly, in actual practice, conventional single-stand multi-pass rolling has been unable to perform such heavy reduction.

Moreover, the strip passing over the work roll must remain in tight contact therewith while rolling is being performed. If there is any slackening, the strip moves widthwise of the strip along the rolls (this phenomenon being known as the "walk" of the strip). In serious cases, the strip becomes folded over and passes between the rolls in a folded condition. This causes overlapped rolling, which can result in strip breakage and mill shutdown.

Furthermore, the conventional single-stand multi-pass rolling is not free from slipping of the strip over the work roll, which may produce slip marks that damage the surface quality of the finished product.

SUMMARY OF THE INVENTION

This invention overcomes the aforementioned problems by providing a new method of rolling metal strip on a single-stand multi-pass rolling mill.

An object of this invention is to provide a method of rolling metal strip that can achieve a large reduction in thickness by controlling the tension on the strip on the exit side of the work roll so as not to exceed the breaking strength of the strip.

Another object of this invention is to provide a method of rolling metal strip that can achieve a large reduction in thickness without causing slackening in the strip passing around the work roll.

Still another object of this invention is to provide a method of rolling metal strip that can achieve a large reduction in thickness without producing slip marks on the surface of the strip.

The strip rolling method of this invention is carried out by using three or more work rolls that are arranged in a line on a single stand so that each two adjoining work rolls form a roll pass therebetween, with the work rolls closer to the exit end of the stand being driven with greater peripheral speeds than the work rolls more remote from the exit end of the stand. Metal strip is passed around half the periphery of the work roll or rolls disposed between the two rolls at both ends of the rolls in the stand, and continuously passed through the roll passes formed between pairs of adjacent opposed work rolls. In this type of single-stand multi-pass rolling, a workpiece enters the first pass formed by a pair of work rolls at a speed that is 0.8 to 1.0 times the peripheral speed of the one of the two work rolls which is driven at a lower speed. Also, the work rolls are driven so that the peripheral speed of the faster-running work roll in a pair of rolls is greater than the speed with which the strip leaves that pair of rolls, at least in one of such pairs of rolls contained in the stand. Furthermore, the strip leaves each of the paired work roll sets at a speed that is 0.8 to 1.2 times the peripheral speed of the one of the two rolls that is driven at a higher speed.

If the peripheral speed of the faster-running work roll becomes higher than the speed of the strip leaving that pair of work rolls, the work roll no longer has a neutral point. By performing such rolling which produces slippage between the work roll and the strip within a certain range, the tension on the strip can be controlled to a proper level, thereby preventing the breaking of the strip being rolled. This is a situation possible to expect only when the respective friction coefficients for all of the work rolls lie within a limited range. However, if the friction coefficients of one or more of work rolls are very great, the faster-running work rolls is driven at a peripheral speed which is lower than the speed of the strip leaving the pass. Then, that part of the strip which winds around the work roll receives frictional force, and is thereby prevented from slackening. The rolling load required by this method is greater than that used by a conventional single-stand multi-pass rolling, but less than one-half that used in a single-stand single-pass method.

By limiting the ratio of the strip speed to the peripheral speed of the work roll to a range of 0.8 to 1.2, the slippage of the strip over the work roll can be controlled so as to prevent the production of slip marks on the strip.

When the rolling speed is high, the strip may be wound a little around the last work roll at the exit end before leaving the stand, whereby chattering-free stable rolling is insured.

DETAILED DESCRIPTION OF THE PREFERRED EMBODIMENTS

Figure 1:
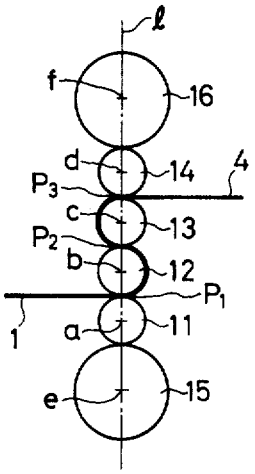
FIG. 1 shows the arrangement of rolls in a single-stand multi-pass rolling mill used for the implementation of the rolling method according to this invention.
Figure 2:
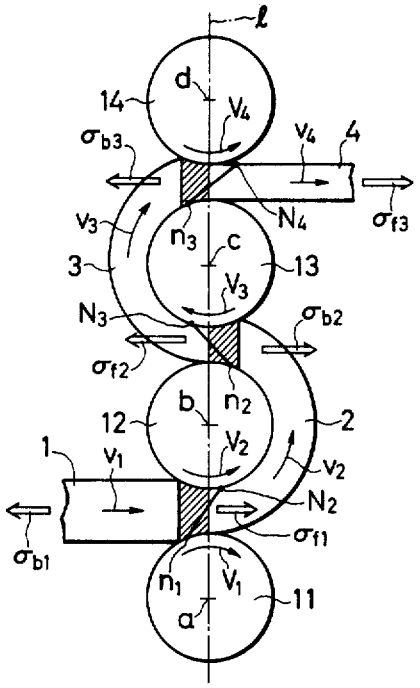
FIG. 2 is a schematic view of the work rolls of the mill of FIG. 1 for illustrating how strip is rolled by the method of this invention, and in which the thickness of the strip is exaggerated in order to show the position of the neutral point.

FIG. 1 shows the way strip is subjected to multi-pass rolling on a six-high rolling mill. In FIG. 2, the thickness of the strip being rolled in FIG. 1 is exaggerated to make it easier to understand the relationship between the speeds of the strip and work rolls. As shown in these figures, work rolls 11 through 14 and backup rolls 15 and 16 are positioned so that their centers a through f are aligned on a vertical line l. The work rolls 11 and 12 form a first pass $P_1$, the work rolls 12 and 13 a second pass $P_2$, and the work rolls 13 and 14 a third pass $P_3$. Strip 1 is passed in one direction (left to right in the figure) through the first pass $P_1$, then in the opposite direction through the second pass $P_2$ and then in the one direction through the third pass $P_3$ in that order, being wound around half the peripheries of the second and third work rolls 12 and 13 when passing from the first to the second pass and from the second to the third pass, respectively.

The work rolls 11 to 14 as thus arranged are driven so that the peripheral speeds V thereof increase toward the exit end of the mill. If the peripheral speeds of the work rolls 11 to 14 are designated as $V_1$, $V_2$, $V_3$ and $V_4$, their relationship is $V_1<V_2<V_3<V_4$. While running through the passes $P_1$, $P_2$ and $P_3$, the strip 1 has the thickness reduced and the speed of travel increased. If the travel speeds of the strip 1 at the entrance of the mill and after each pass are designated as $v_1$, $v_2$, $v_3$ and $v_4$, their relationship is $v_1<v_2<v_3<v_4$. The hatched portions in FIG. 2 show roll bites where the strip is in contact with the work rolls.

In the rolling method of this invention, as disclosed above, the peripheral speeds of the work rolls and the travel speed of the strip are in a special interrelationship, which will now be described in detail with reference to FIG. 2.

In the pair of work rolls 11 and 12 forming the first pass $P_1$, as stated previously the work roll 11 rotates at a lower speed than the work roll 12. The peripheral speed $V_1$ of the work roll 11 is greater than the speed $v_1$ at which the strip 1 enters the pass $P_1$. Therefore, there exists a lower-speed work roll neutral point $n_1$ for the work roll 11 and it lies within the arc where the strip 1 contacts the work roll 11. This speed condition is maintained by means of the work roll speed control described later.

This speed condition for the work roll 11 is the same as that employed in conventional rolling, and is for helping the entry of the strip 1 into the pass.

It is preferable that the ratio ($v_1/V_1$) of the entry speed $v_1$ of the strip 1 to the peripheral speed $V_1$ of the work roll 11 lies within the range of $0.8 \leqq v_1/V_1 < 1$. If $v_1/V_1$ is smaller than 0.8, the relative speed difference or slippage between the strip 1 and the work rolls 11 and 12 becomes so great that slip marks may be produced on the surface of the strip. If, conversely, $v_1/V_1$ is greater than 1, mis-entry of the strip is likely to occur.

The faster-running work roll 12, which forms the first pass $P_1$ together with the work roll 11, has a peripheral speed $V_2$ which is greater than the speed $v_2$ with which the strip 2 leaves the pass $P_1$. Therefore, there is no higher-speed work roll neutral point $N_2$ of this work roll 12 within the arc of contact. In FIG. 2, the neutral point $N_2$ is shown on the exit side of the arc of contact. But it should be noted that this figure, which is drawn to schematically illustrate that the higher-speed work roll neutral point $N_2$ does not lie within the arc of contact, does not necessarily show the real position (if any) of the higher-speed work roll neutral point $N_2$.

It is preferable that the ratio ($v_2/V_2$) of the exit speed $v_2$ of the strip 1 to the peripheral speed $V_2$ of the work roll 12 lies within the range of $0.8 \leqq v_2/V_2 < 1$. If $v_2/V_2$ is smaller than 0.8, the aforementioned slippage marks are likely to be caused. For the peripheral speed $V_2$ of the work roll 12 to be greater than the exit speed $v_2$ of the strip 1, the ratio $v_2/V_2$ must be smaller than 1. As will be discussed later, $v_2/V_2<1$ is an essential requirement for reducing the tension on the strip and preventing breaking of the strip 2 extending around the periphery of work roll 12.

With respect to the second and third passes $P_2$ and $P_3$, as in the case of the first pass $P_1$, the work rolls 13 and 14 are driven so that the peripheral speeds $V_3$ and $V_4$ thereof are greater than the exit speeds $v_3$ and $v_4$ of the strip, i.e. $v_3/V_3<1$ and $v_4/V_4<1$. Accordingly, no higher-speed work roll neutral points $N_3$ and $N_4$ exist within the respective arcs of contact.

The smaller the speed ratios $v_3/V_3$ and $v_4/V_4$, the greater the speed difference or slippage between the strip and work rolls. Since too much slippage can cause slip marks, the lower limit of the speed ratios $v_3/V_3$ and $v_4/V_4$ is set at 0.8, as in the first pass $P_1$.

With respect to the lower-speed work rolls 12 and 13 forming the second and third passes $P_2$ and $P_3$, naturally, relationships $v_2/V_2<1(v_2<V_2)$ and $v_3/V_3<1(v_3<V_3)$ hold. Therefore, the neutral points $n_2$ and $n_3$ of the work rolls 12 and 13 lie within the arcs of contact, as shown in FIG. 2. This is the same as for the neutral point $n_1$ of the lower-speed work roll 11 forming the first pass $P_1$, which lies within the arc of contact.

The first technical problem of this invention was how to achieve heavy-draft rolling while keeping the tension on the strip on the exit side of the rolling mill at a low level. This problem has been solved by rolling the strip with the rolls that are driven at the peripheral speeds as described above. The following paragraphs describe the reason for this.

There is applied to the strip nipped between the work rolls a vertical stress or rolling pressure p exerted by the rolls and a horizontal stress $\sigma$ due to the friction between the work rolls and strip. In order for the strip to change its shape during drafting, it is necessary that $k=p+\sigma$, where k is the deformation strength of the strip.

In the conventional single-pass strip rolling, there is a neutral point which lies within the arc of contact, and a frictional force directed from the entrance to the neutral point acts on the strip on the entry side of the roll bite, and a frictional force directed from the exit to the neutral point acts on the strip on the exit side of the roll bite. Accordingly, the horizontal stress in the roll bite becomes greatest at the neutral point. As a consequence, the rolling pressure follows an angular line, as indicated at C in FIG. 3.

It will now be described how the rolling pressure in the first pass of the present invention changes. As described above (see FIG. 2), there is neutral point $n_1$ for the lower-speed work roll and it lies inside the roll bite, so that the rolling pressure increases along line I on the entry side of the roll bite, similar to the line C, and decreases on the exit side. The rolling pressure indicated by the line I is lower than that indicated by the line C because the strip 1 receives from the higher speed work roll a horizontal stress throughout the arc of contact due to the frictional force directed toward the exit side of the rolling mill.

The rolling pressures in the second and third passes also change in the same manner as in the first pass. As evident from FIG. 3, the rolling pressure $p_{f3}$ at the exit side of the rolling mill is not significantly different from the rolling pressure $p_{b1}$ at the entry side thereof. The rolling pressure $p_{b2}$ at the entry side of the second pass is slightly higher than the rolling pressure $p_{f1}$ at the exit side of the first pass. This is because the peripheral speed $V_2$ of the work roll 12 is greater than the exit speed $v_2$ of the strip, as a result of which the strip 2 wound around the work roll 12 is pushed into the second pass by the resulting frictional force. This, in turn, reduces the tension $\sigma_{b2}$ acting on the strip 2.

If the deformation strength of the strip at the exit side of the rolling mill is $k_f$, the tension at the exit side is $\sigma_{f3}=k_f-p_{f3}$. Since the deformation strength $k_f$ is substantially constant, the greater the rolling pressure, the smaller the tension $\sigma_{f3}$. In the case of this invention, as described above, the rolling pressure $p_{f3}$ at the exit side of the rolling mill is not greatly different from the rolling pressure $p_{b1}$ at the entry side thereof. That is, the rolling pressure $p_{f3}$ is relatively great. Thereafter, the tension $\sigma_{f3}$ at the exit side of the rolling mill is small. This is in striking contrast to the conventional single-stand multi-pass rolling method.

Figure 3:
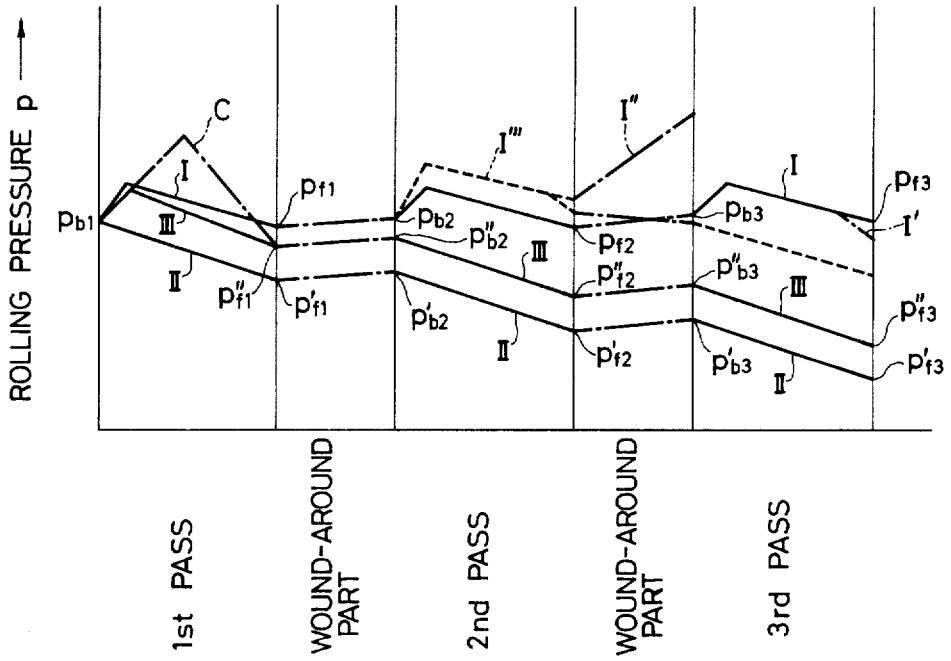
FIG. 3 is a diagram showing the rolling pressure changes during the progress of the rolling operation according to the method of this invention as compared with the conventional method.

Line II in FIG. 3 shows the rolling pressure resulting from the application of the method disclosed in U.S. Pat. No. 3,709,017 to three-pass rolling. In this case, there is, or is not, a neutral point just at the entry end of the arc of contact for the first work roll (which corresponds to the work roll 11 in FIG. 2). For other work rolls, the neutral point of the higher-speed roll is positioned at the exit end of the arc of contact, and that of the lower-speed roll at the entry end thereof. Accordingly, the frictional force exerted on the strip by the higher-speed work roll acts in such a manner as to negate the frictional force applied by the lower-speed roll. Consequently, the rolling pressure drops toward the exit end of each pass. Where the strip is wound around the roll, the peripheral speed of the work roll equals the strip speed, so that the rolling pressure ($p'_{f1}$, $p'_{f2}$) at the exit side of each pass is nearly equal to the rolling pressure ($p'_{b2}$, $p'_{b3}$) at the entry side of the next pass.

The rolling pressure $p'_{f3}$ on line II is considerably smaller than the rolling pressure $p_{f3}$ at the exit side of the rolling mill in the method according to this invention (line I). From the relation $\sigma_{f3}=k_f-p_{f3}$, this means that the tension $\sigma'_{f3}$ at the exit side of the rolling mill becomes extremely great in the conventional single-stand multi-pass rolling. In the method of this invention, for example, when $\sigma_{b1}=5$ to 10 Kg/mm$^2$, then $\sigma_{f3}=15$ to 20. By contrast, in the conventional method, when $\sigma'_{b1}=5$ Kg/mm$^2$, $\sigma'_{f3}$ becomes as great as approximately 75 kg/mm$^2$.

Line III in FIG. 3 shows the rolling pressure in another conventional single-stand multi-pass rolling (Japanese Patent Laid-open No. 84,850 of 1979), which is an improvement on the method shown by line II. In this method, the neutral point of the first roll lies within the arc of contact. Therefore, the change in the rolling pressure in the first pass is similar to that according to this invention. The second and third passes produce the same rolling as does the method of U.S. Pat. No. 3,709,017 described above. Therefore, the rolling pressure therein drops, similar to line II. With the single-stand multi-pass rolling method indicated by line III, the rolling pressure $p''_{f3}$ at the exit side of the rolling mill is also much lower than the rolling pressure $p_{f3}$ applied by the method of this invention. Accordingly, the tension on the exit side of the rolling mill cannot be reduced to any appreciable extent.

In the first pass, line I is above line II. This is because, as stated previously, there is no neutral point along the arc of contact of the faster roll 12 in the first pass according to the present invention, i.e. the peripheral speed $V_2$ of the second work roll 12 is greater than the exit speed $v_2$ of the strip. To elaborate on this point, the coefficient of friction $\mu$ between the metal workpiece being rolled and the work roll can generally be expressed as follows:

$$\mu \propto \frac{P_b\theta}{\eta_o e^{-\delta Tb}(V+v)} \quad (1)$$

where $P_b$ is the rolling pressure at the entry side of the roll bite, $\theta$ is the angle of the bite, $\eta_o$ is the viscosity of rolling lubricant, $\delta$ is the temperature coefficient ($\delta=0.06$ for steel), Tb is the temperature of the lubricating oil at the entry side of the roll bite, V is the peripheral speed of the work roll, and v is the strip speed at the entry side of the roll bite.

Where there is no neutral point within the arc of contact, as in the case of the present invention, the slippage between the strip and work roll increases, as described before. Therefore, the strip speed v at the entry side of the roll bite drops. If the peripheral speed V of the roll is constant, $V+v$ becomes smaller, and, as is evident from equation (1), the friction coefficient $\mu$ becomes larger. Also, the difference $|V-v_m|$ between the peripheral speed V of the roll and the mean strip speed $v_m$ in the roll bite increases, and the temperature Tb becomes higher because of the heat of friction generated by the slippage between the work roll and strip. Therefore, $e^{-\delta Tb}$ becomes smaller, and then, as evident from equation (1), the coefficient of friction $\mu$ increases. In short, making the peripheral speed of the roll greater than the exit speed of the strip at the exit side of the roll pass increases the friction coefficient $\mu$ between the work roll and strip because of the increased slippage therebetween.

The rolling pressure p in the roll bite is expressed as follows:

$$pae^{\mu H/ho} \quad (2)$$

where H is the thickness of the strip at the entry side of the work roll, and ho is the thickness of the strip at the exit side. Thus, if the peripheral speed of the roll is made greater than the exit speed of the strip at the exit side of the roll pass, the friction coefficient $\mu$ increases, according to equation (1). Consequently, as evident from equation (2), the rolling pressure p also increases.

The second technical problem of this invention was how to apply tension at all times to each pair of rolls and the strip held therebetween. The inventors have made it clear that the tension acting on that part of the strip which extends around the periphery of a work roll depends upon the draft carried out by the same roll and another adjoining opposed roll. That is, as the draft exerted by a pair of opposed adjacent work rolls increases, the tension applied to part of the strip extending around the roll decreases.

It has also been found that appropriate tension force can be applied at all times to the strip extending around the work roll by controlling the rotating speed of the work rolls so that the neutral point between the strip that contacts the higher-speed roll of each roll pair and said roll is positioned at the exit end of the arc of contact with the roll or there is no neutral point within the arc of contact.

For example, if, in the second pass $p_2$, the speed of the work roll 13 is made greater than that of the work roll 12, the friction coefficient between the strip 2 and the higher-speed work roll 13 increases, whereby the strip 2 is driven with a greater force. Consequently, the tension $\theta_{b2}$ at the entry side increases, remaining positive, and the slackening of the strip 2 is prevented. Furthermore, the tension $\theta_{b3}$ at the entry side of the pass 3 becomes smaller than the tension $\theta_{f2}$ at the exit side and the breaking at the strip 3 is prevented, too.

Figure 4:
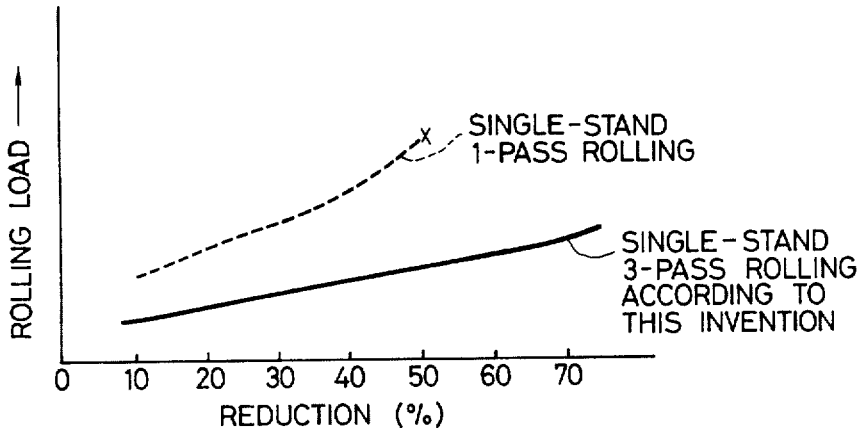
FIG. 4 is a graphical representation of the relationship between the draft and rolling load for a single-stand three-pass rolling according to this invention and a conventional single-stand one-pass rolling.

As described with reference to FIG. 3, the rolling pressure applied by the method of this invention is a little greater than in the conventional single-stand multi-pass rolling. Yet the rolling load applied by the method of this invention is considerably smaller than that applied by the conventional single-stand single-pass rolling. FIG. 4 compares the rolling loads of a single-stand three-pass rolling according to this invention and a conventional single-stand single-pass rolling. As seen, the former is less than one-half the latter, so that a reduction as great as or more than 70 percent can be achieved on a single stand. In FIG. 4, symbol x designates the limit of reduction attainable by a conventional single-stand single-pass rolling.

In the embodiment shown in FIG. 2, the peripheral speed of the higher-speed work roll in each pass is made greater than the exit speed of the strip. As a consequence, there is no neutral point for the higher-speed roll. But the rolling method of this invention does not require this speed condition for all passes. In the third pass of the embodiment shown in FIG. 5, for example, the peripheral speed $V_4$ of the higher-speed work roll 14 is smaller than the speed $v_4$ with which the strip leaves the same pass. Therefore, a higher-speed work roll neutral point $N_4$ exists which lies inside the arc of contact. As shown in FIG. 3, the rolling pressure in this embodment changes in the same way as with the embodiment of FIG. 2 in the first and second passes, but drops somewhat in the third pass as indicated by line I'.

As described previously, the method of this invention can prevent the slackening or breaking of the part of the strip extending around the periphery of the work roll. However, when the friction coefficient of the work roll is too great, such slackening can happen. If, for example, the friction coefficient of the work roll 13 in FIG. 2 is very great, the part 3 of the strip extending therearound is forced into the third pass by the large frictional force exerted by the roll 13. Accordingly, the tension $\sigma_{b3}$ working on the strip at the entry side of the third pass decreases, and if it changes to negative (i.e. a compressive force) part 3 of the strip slackens. As a result of the decrease in the tension $\sigma_{b3}$, the rolling pressure at the entry side of the third pass becomes very much greater than the rolling pressure at the exit side of the second pass. Line I'' in FIG. 3 shows this increase in the rolling pressure.

Figure 6:
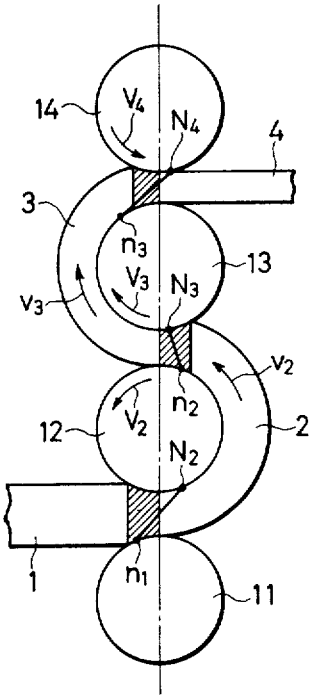
FIG. 6 shows still another embodiment of this invention, in which one of the work rolls has a large coefficient of friction.

FIG. 6 shows the speed requirements for the work rolls that are necessary for preventing the slackening of the strip when the friction coefficient of the work roll 13 is very great. That is, the lower-speed work roll 12 and the higher speed-work roll 13, which form the second pass, are driven so that the lower and higher-speed work roll neutral points $n_2$ and $N_3$ thereof exist and lie inside the respective arcs of contact, by making $V_2 > v_2$ and $V_3 < v_3$. Since $V_3 < v_3$, the work roll 13 does not push the part 3 of the strip into the third pass. Then, since $\sigma_{b3} > \sigma_{f2}$, no slackening occurs. Line I''' in FIG. 3 shows the change in the rolling pressure in the embodiment shown in FIG. 6. In this case, a condition of $v_3/V_3 > 1$ holds, but it should be limited to $1.2 > v_3/V_3 > 1$, if the production of slip marks is taken into consideration.

Figure 7:
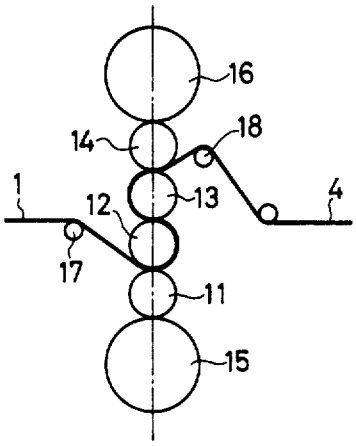
FIG. 7 is a diagram showing how the strip is passed over the work rolls at the entry and exit ends of a roll stand.

In FIG. 1, the strip enters the first pass $P_1$ horizontally and leaves the third pass $P_3$ horizontally. But when the peripheral speed of the rolls becomes higher than, for example, 100 m/min., the strip leaving the rolling mill may possibly cause chattering. Such chattering can be prevented by providing a guide roll 18 near the work roll 14, as shown in FIG. 7, to guide the strip 4 so that it is wound around the work roll 14 along a short arc of contact. When the strip is thus wound around the work roll 14, chattering can be prevented and stable rolling results. The same goes for the entry side of the rolling mill where a guide roll 17 is provided for strip 1 near work roll 12. The length of the arc along which the strip is caused to contact the work roll should preferably be more than approximately one-eighth of the circumference of the work roll.

Figure 8:
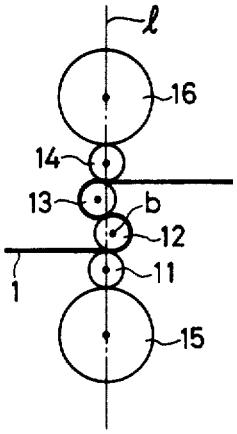
FIG. 8 is a diagram of a roll stand used for the implementation of the method of this invention, in which work rolls are disposed in a zigzag arrangement.

In FIG. 1, the work rolls 11 to 14 are arranged so that the centers a to d thereof are aligned on a vertical line l. However, the position of the inner work rolls 12 and 13 may be shifted a little as shown in FIG. 8. The rolls must be shifted in a direction opposite to the direction of the force that is exerted thereon by the strip wound therearound. For example, the work roll 12 is positioned so that the center b thereof lies on the right side of the vertical line l because the force the work roll 12 receives from the wound-around strip acts toward the left. By thus shifting the position of the work rolls 12 and 13, each roll is horizontally supported by the adjoining rolls; for example, the work roll 12 is supported by the work rolls 11 and 13. Consequently, the work rolls 12 and 13 are subject to less deformation due to the horizontal force, whereby the diameter thereof can be reduced, which, in turn, permits still heavier drafting.

Figure 9:
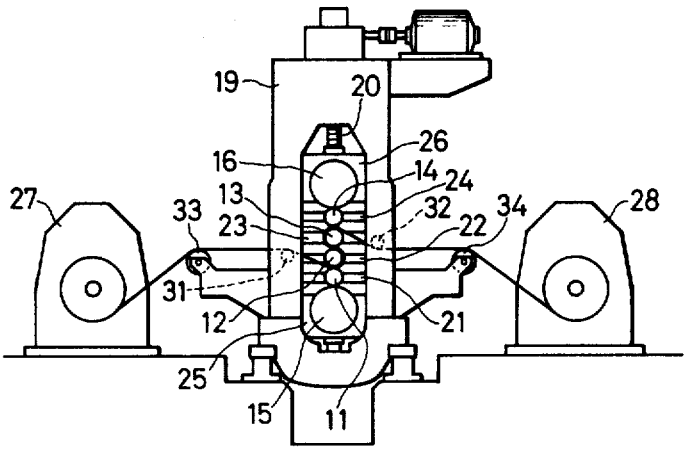
FIG. 9 is a side elevation of a complete roll stand on which the rolling method of this invention can be carried out.

FIG. 9 shows a multi-pass rolling mill stand which is used for carrying out the rolling method according to this invention. The work rolls 11 to 14 and backup rolls 15 and and 16 shown in FIG. 1 are mounted in a housing 19. The rolls 11 through 16 are supported by roll chocks 21 to 26, through which a screwdown device 20 applies a rolling load. The housing 19 also carries guide rolls 31 and 32 on the entry and exit sides thereof, respectively. An uncoiler 27 and a coiler 28 are provided on the entry and exit sides of the stand, with a deflector roll 33 positioned between the uncoiler 27 and the guide roll 31 and a deflector roll 34 positioned between the coiler 28 and the guide roll 32.

Figure 5:
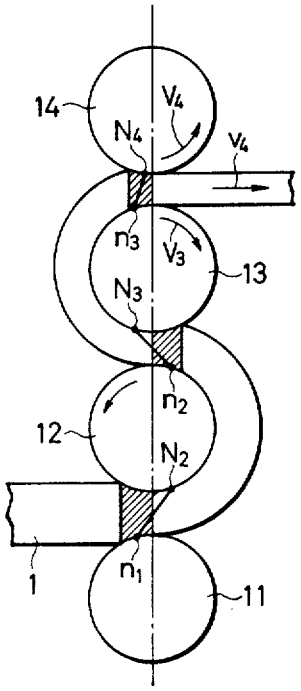
FIG. 5 shows another embodiment of this invention in which the position of the neutral point is different from that in FIG. 2.

The rolling mill stand shown in FIG. 9 is the same as that used for a conventional single-stand multi-pass rolling. The rolling method of this invention is carried out by adjusting or controlling the peripheral speeds of the work rolls 11 to 14 so that the neutral points thereof are positioned as shown in FIGS. 2, 5 or 6.

Figure 10:
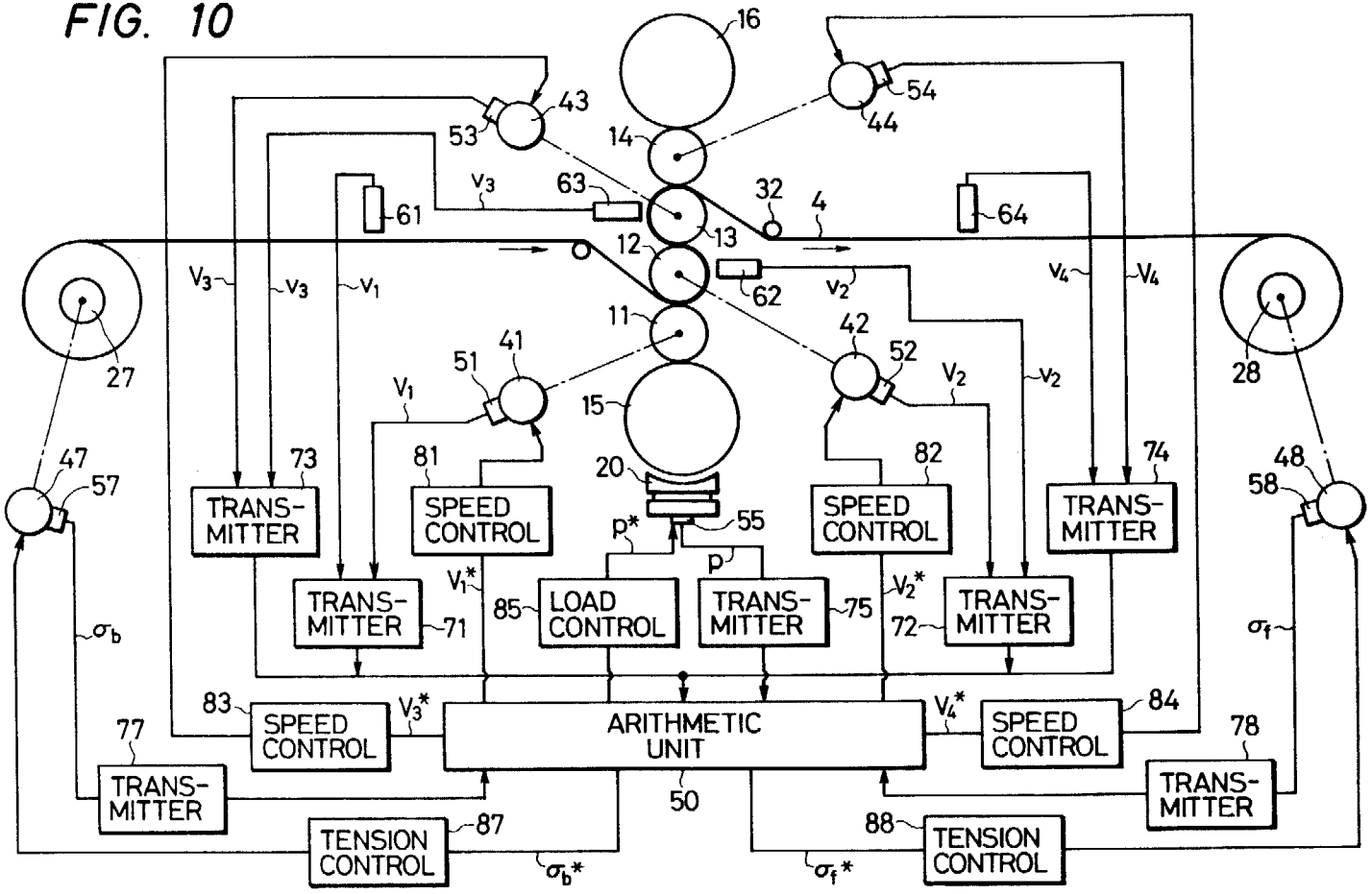
FIG. 10 is a diagram of a system that controls the peripheral speeds of the work rolls used for the implementation of the method of this invention.
Figure 11:
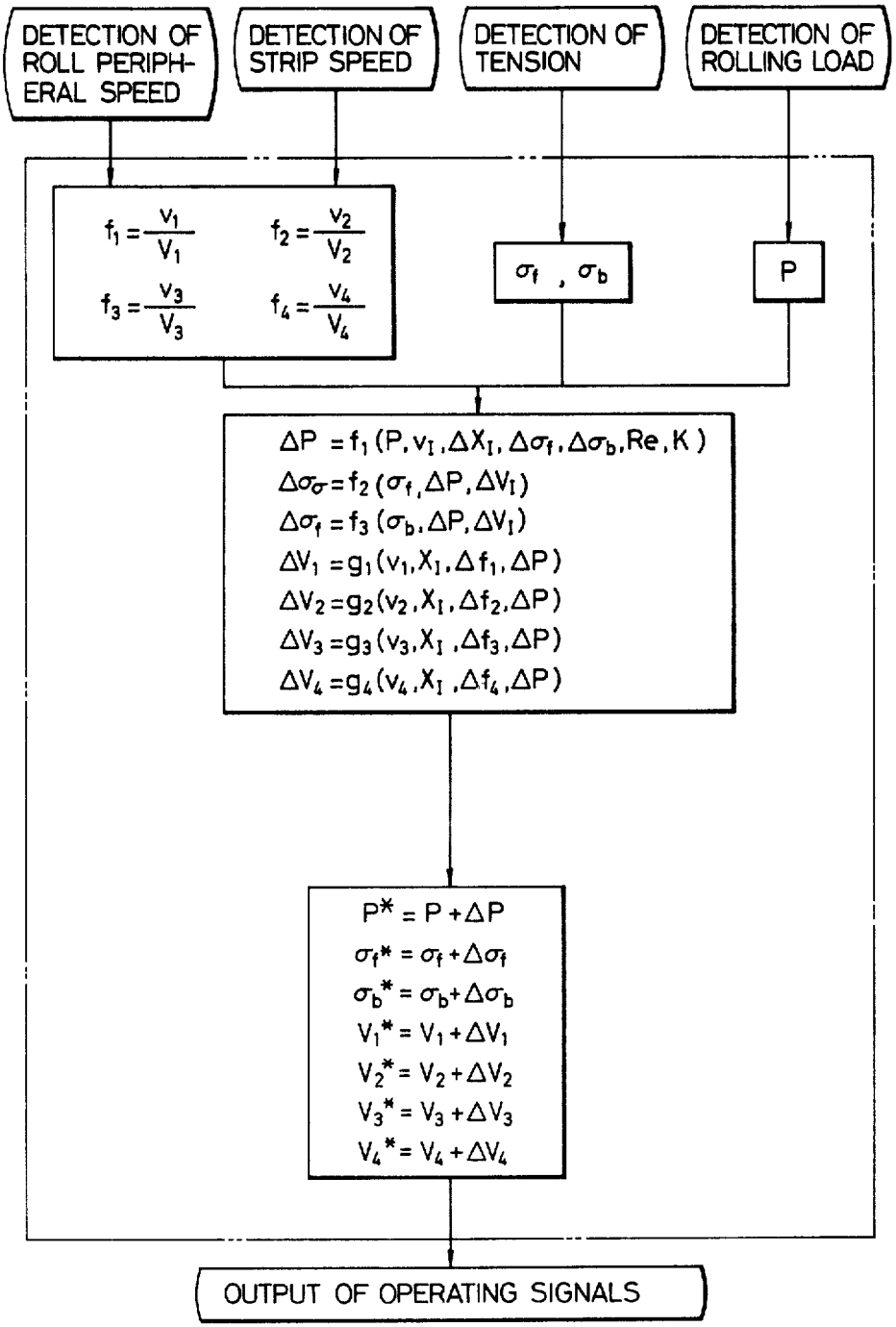
FIG. 11 is a flow chart of the operation performed by an arithmetic unit for the control of the peripheral speeds of the work rolls.

The following paragraphs describe the way the speeds of the work rolls are controlled, reference being made to FIGS. 10 and 11. The peripheral speeds $V_1$ to $V_4$ of the work rolls 11 through 14 are measured by detecting the speeds of rotation of the roll drive motors 41 to 44 by means of detectors 51 to 54. Detection signals from the detectors 51 to 54 are inputted into an arithmetic unit 50 through transmitters 71 to 74. The strip speed is detected by noncontact type speed sensors 61 to 64 on the entry side of the rolling mill stand and on the exit sides of the first, second and third passes. Detection signals $v_1$ to $v_4$ therefrom are also inputted to the arithmetic unit 50 through the transmitters 71 through 74. The tensions $\sigma_b$ and $\sigma_f$ of the strip on the entry and exit sides of the rolling mill stand are determined by detecting the currents supplied to drive motors 47 and 48 of the uncoiler 27 and coiler 28 by means of detectors 57 and 58. Signals representing the tensions $\sigma_b$ and $\sigma_f$ thus detected are inputted to the arithmetic unit 50 through transmitters 77 and 78. A load cell 55 incorporated in the screwdown device 20 detects the rolling load P, and a signal representing the detected load is inputted to the arithmetic unit 50 through a transmitter 75.

In the arithmetic unit 50, the forward slip factor $f_i$ is calculated based on the peripheral speed of the roll $V_i$ and the strip speed $v_i$ ($f_i = v_i/V_i$), as shown in FIG. 11. Then, based on the forward slip factor $f_i$, tensions $\sigma_f$ and $\sigma_b$, and rolling load P, the peripheral speeds of the work rolls are determined which bring the neutral points thereof into the positions, for example, as shown in FIGS. 2, 5 or 6. In FIG. 11, $f_1$ through $f_3$ and $g_1$ through $g_4$ denote the functions empirically determined on the actual rolling mill. Of the variables, $x_1$ designates the ratio of the peripheral speeds of the rolls ($V_{i+1}/V_i$), Re the total reduction, and k the modulus of elasticity of the rolling mill stand.

Figure 12:
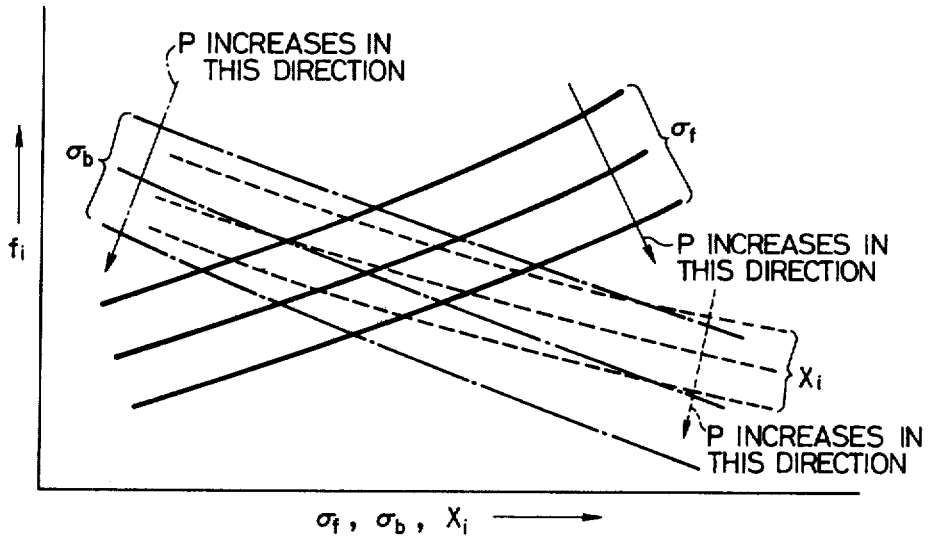
FIG. 12 is a diagram that shows the qualitative relationship between the strip tension, the peripheral speed ratio and forward slip factor, using the rolling load as a parameter.

FIG. 12 diagrammatically shows the qualitative relationship between the tensions $\sigma_f$ and $\sigma_b$, the ratio x, of the peripheral speeds of the rolls, and the forward slip factor $f_i$, using the rolling load P as a parameter, based on the empirically determined data. This diagram, from which the group of functions $f_1$ through $f_3$ and $g_1$ through $g_4$ are determined, is stored in the arithmetic unit 50. That is, FIG. 12 shows how the forward slip factor changes with the changes in various rolling conditions ($\sigma_b$, $\sigma_f$, $x_i$ and P). From this, the changes in the speed, tension and load of each roll corresponding to a change in the forward slip factor are calculated, and the rolling operation is controlled based on the results obtained. The functions representing the changes in the speed, tension and load of the individual rolls with a change in the forward slip factor are indicated in FIG. 11 as $f_1$ through $f_3$ and $g_1$ through $g_4$.

From the group of functions $f_1$ through $f_3$ and $g_1$ through $g_4$ are determined the amounts by which the rolling load P, tensions $\sigma_f$ and $\sigma_b$, and peripheral speeds $V_1$ to $V_4$ of the rolls are to be corrected. Then, the arithmetic unit 50 outputs corrected operating signals; i.e. peripheral speed signals $V_1^*$ to $V_4^*$ are sent through controllers 81 to 84 to the drive motors 41 to 44, tension signals $\sigma_b^*$ and $\sigma_f^*$ through controllers 87 and 88 to the drive motors 47 and 48, and a load signal P* through a controller 85 to the screwdown device 20.

The lower-speed roll (designated by reference numeral 11 in FIG. 10) on the entry side of the rolling mill stand may be an idle roll, in which case there is no need to control the lower-speed roll 11 as described above.

EXAMPLE

Using a 0.8 mm thick low-carbon steel strip as the starting material, single-stand three-pass rolling was performed on the six-high rolling mill shown in FIG. 1. The diameter of the work rolls was 150 mm, and the total reduction was 70 percent. The entry-side tension $\sigma_b$ was 5 kg/mm$^2$.

The individual roll and strip speeds and the amount of reduction in each pass are listed in Table 1 below.

TABLE 1

| Roll Speed, m/min. | Strip Speed, m/min. | Reduction, % |
|---|---|---|
| $V_1 = 36$ | $v_1 = 30$ | 1st pass = 44 |
| $V_2 = 64$ | $v_2 = 54$ | 2nd pass = 29 |
| $V_3 = 83$ | $v_3 = 76$ | 3rd pass = 25 |
| $V_4 = 100$ | $v_4 = 101$ | |
| | | Total = 70 |

When rolled under the above conditions according to the method of this invention, there was no slackening of the strip as it passed around the rolls 12 and 13 and the exit-side tension $\sigma_f$ was 20 kg/mm$^2$.

When the same strip was rolled under the same conditions, but in a conventional multi-pass rolling method, the exit-side tension became so great that the strip broke, making it impossible to continue rolling.

Experiments performed by the inventors have shown that when the conventional method is carried out with a total reduction of 66 percent and an entry-side tension $\sigma_b$ of 5 kg/mm$^2$, the exit-side tension $\sigma_f$ becomes as great as 75 kg/mm$^2$ exceeding the breaking strength of the strip.

This invention should not be considered as being limited to the preferred embodiments described above. The abovedescribed embodiments are all designed to perform a three-pass rolling using four work rolls. But, for example, the number of work rolls may be increased to perform a five-pass or seven-pass rolling. The work rolls, which are arranged vertically in the embodiments, may also be arranged horizontally. Furthermore, the work rolls need not be of the same diameter. Rolls having different diameters may be used as well.

What is claimed is:

1. In a method of rolling metal strip in a rolling mill stand having at least three work rolls positioned substantially in a line with each other with each pair of adjoining work rolls forming a roll pass therebetween, the pair of work rolls at one end of the line forming an entry pass at an entry end of the stand and the pair of work rolls at the other end of the line forming an exit pass at an exit end of the stand, and which method includes driving the work rolls in the successive positions toward the exit end of the stand at increasingly greater peripheral speeds with each pair of adjoining work rolls having a lower-speed work roll toward the entry end of the stand and a higher-speed work roll toward the exit end of the stand, and feeding the metal strip into the entry pass, around the peripheries of the work rolls positioned between the work rolls at the respective ends of the line and through the rolls at the respective ends of the line and through the roll pass formed between each pair of adjoining work rolls along the line, the improvement which comprises:

controlling the speed of at least the higher-speed roll forming the entry pass for causing the ratio of the entry speed of the strip to the peripheral speed of the lower-speed work roll in the entry pass to be greater than 0.8 and less than 1; and driving the work rolls for causing the peripheral speed of the higher-speed work roll in one of the pairs of adjoining work rolls to be greater than the exit speed of the strip from said one of the pairs of adjoining work rolls, and, at the same time, controlling the speeds of the rolls forming all the passes other than the entry pass for causing the ratio of the exit speed of the strip to the peripheral speed of the higher-speed work roll in each such pass to lie between 0.8 and 1.2.

2. The improvement as claimed in claim 1 in which only the higher-speed work roll of the entry pass, the higher-speed work roll of the exit pass and all of the work rolls located between said higher-speed work roll of the entry pass and said higher-speed work roll of the exit pass are driven.

3. The improvement as claimed in claim 1 in which all of the work rolls are driven and the lower speed work roll of the entry pass is controlled so as to cause the ratio of the entry speed of the strip to the peripheral speed of the lower-speed work roll of the entry pass to be greater than 0.8 and less than 1.

4. The improvement as claimed in claim 1 in which the peripheral speed of the higher-speed work roll in the exit pass is controlled so as to be less than the exit speed of the strip from the exit pass, and the peripheral speed of the higher-speed work roll in a roll pass other than the exit pass is controlled so that it is higher than the exit speed of the strip from the other pass.

5. The improvement as claimed in claim 1 further comprising winding the strip around a part of the periphery of one of the rolls of the exit pass on the exit side of said exit pass for preventing chattering.

* * * * *